US005997442A

United States Patent [19]

Cordes

[11] Patent Number: 5,997,442

[45] Date of Patent: Dec. 7, 1999

[54] PORTABLE MULTI-PURPOSE EXERCISE SYSTEM

[76] Inventor: Richard A. Cordes, 1343 Locust St., Suite 202, Walnut Creek, Calif. 94596

[21] Appl. No.: 09/080,015

[22] Filed: May 15, 1998

[51] Int. Cl.[6] ..... A63B 21/075; A63B 22/00

[52] U.S. Cl. ..... 482/52; 482/104; 482/142; 482/910

[58] Field of Search ..... 482/52, 93, 94, 482/104, 142, 910

[56] References Cited

U.S. PATENT DOCUMENTS

| | | | |
|---|---|---|---|
| 5,162,028 | 11/1992 | Wilkinson | 482/52 |
| 5,575,742 | 11/1996 | Wu | 482/52 |
| 5,697,870 | 12/1997 | Osborn | 482/52 |

*Primary Examiner*—John Mulcahy
*Attorney, Agent, or Firm*—Townsend and Townsend and Crew LLP

[57] ABSTRACT

A portable, multi-purpose exercise system that includes dumbbell bars configured for interconnection to form a barbell and a plurality of hollow, rigid discs configured for attachment to the dumbbell bars. The discs are fillable with water to provide a consistent and accurate amount of weight. The discs and dumbbell bars are stored within a portable transport and storage case that may be used as a bench for weightlifting exercises and a bench step for aerobic exercise. A headrest is included that is attachable to the storage case and extension blocks are provided for adjusting the height of the storage case when used for exercise. The extension blocks also provide extra storage space for other items, along with a separate storage compartment that is configured for storing the headrest when not in use.

9 Claims, 9 Drawing Sheets

PORTABLE MULTI-PURPOSE EXERCISE SYSTEM

BACKGROUND OF THE INVENTION

1. Field of the Invention

The present invention relates to a portable, multi-purpose exercise system, and more particularly, to a portable exercise system that can be used for weightlifting and aerobic workouts.

2. Description of the Prior Art

Exercise is known to be an important part of a healthy lifestyle. Unfortunately, in today's busy society many people have a difficult time finding the time to exercise. The problem is compounded when one frequently travels.

One form of exercise that is popular is weightlifting. Another form that is also popular includes aerobic exercises. Both forms are regarded as important compliments to each other for a healthy lifestyle. Health clubs, gyms and other types of businesses that cater to overall health and fitness generally provide "free weights" for weightlifting, various weight machines, and various forms of equipment for aerobic exercises. These types of businesses, however, generally require membership fees. Accordingly, when one is traveling, one may not be able to exercise unless the business of which they are a member has a branch or chapter located in the town in which the person is traveling. Therefore, it would be convenient to be able to exercise in one's hotel room or wherever one happens to be staying. Unfortunately, it is not practical or even possible to carry sets of weights when one is traveling.

Attempts have been made to provide fluid-filled weights for dumbbells. One such item is an expandable/collapsible dumbbell weight. The dumbbell weights may be filled with water to provide the weight for weightlifting. Unfortunately, this requires the user to fill and drain the weights to achieve the desired weight during workouts. This can be extremely inconvenient and requires a lot of "guesswork" on the part of the user. Additionally, these dumbbell weights are susceptible to holes and other forms of leaks.

Another item is a fixed-weight fluid fillable dumbbell weight wherein the sides and dumbbell bar are hollow and filled with fluid in order to reach a predetermined weight. An additional dumbbell weight or reservoir may be attached to either side for additional weight. This weight system's capacity is very inflexible and the system's usefulness is limited to dumbbell exercises only.

Both of these weight systems are awkward, inconvenient and, in most cases, inadequate for proper weightlifting exercises. Additionally, these systems do not provide for any form of aerobic activity.

SUMMARY OF THE INVENTION

A portable exercise system in accordance with the present invention addresses the shortcomings of the prior art.

A portable, multi-purpose exercise system in accordance with the present invention comprises at least two dumbbell bars configured for interconnection, a plurality of hollow, rigid discs configured for attachment to the dumbbell bars, a storage case that includes divided segments for receiving the discs and at least one portion for receiving the dumbbell bars, a headrest configured for attachment to the storage case, a storage compartment configured for attachment to the storage case and including a portion for storing the headrest, and at least two extension blocks configured for attachment to the storage case and configured for attachment to the storage compartment.

In accordance with one aspect of the present invention, the storage case includes a telescoping handle connected to a first end of the storage case and at least one roller connected to an opposite end of the storage case.

In accordance with another aspect of the present invention, the headrest is configured for attachment to the handle.

In accordance with a further aspect of the present invention, the exercise system includes at least two hand grips configured for connection to the dumbbell bars.

In accordance with yet another aspect of the present invention, the exercise system includes eight collars for attachment to the dumbbell bars, for locking the discs on the dumbbell bars when the discs are attached thereon.

In accordance with a further aspect of the present invention, the plurality of hollow, rigid discs consists of four discs of a first size, four discs of a second size, four discs of a third size, four discs of a fourth size, and four discs of a fifth size.

Accordingly, the present invention provides a portable, multi-purpose exercise system that includes dumbbell bars that may be interconnected to form a bar bell. Additionally, the exercise system includes a plurality of hollow, rigid discs that may be filled with a fluid, such as water. Preferably, discs are provided in a variety of sizes so that the discs, when filled, provide a variety of weights. Thus, the discs may be attached to the dumbbell bars, or to the dumbbell bars interconnected as a bar bell, so that various weightlifting exercises may be performed.

The storage case carries the dumbbell bars and the discs but may also be used with the headrest as a bench for various weightlifting exercises. Also, the storage case may be used as a bench step for aerobic exercises and even certain weightlifting exercises, such as, for example, squats, step-ups, etc. Additionally, the height of the storage case may be adjusted by attaching the extension blocks or removing the extension blocks.

Thus, an exercise system in accordance with the present invention may be used to perform a multitude of exercises without the need to purchase and transport several different fitness products and accessories. Additionally, the exercise system is easy to transport and lightweight and allows a user to perform the exercises in the convenience of their hotel room, office or even home.

DETAILED DESCRIPTION OF THE PREFERRED EXEMPLARY EMBODIMENTS

Figure 1:
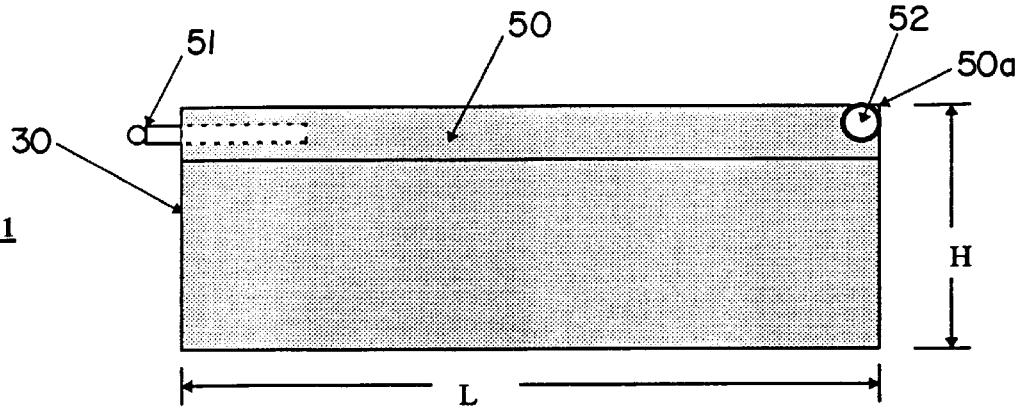
FIG. 1 is a side elevation view of a storage case of an exercise system in accordance with the present invention.

An exercise system in accordance with the present invention preferably includes a storage case 30, four dumbbell bars 31, four handgrips 32, eight collars 33, a plurality of plates or discs 34 of varying sizes, a headrest 39, a storage compartment 40, and two extension blocks 41. Preferably, the exercise system includes between three and seven sizes of discs 34. In a most preferred embodiment, the exercise system includes five sizes of discs, specifically, four 1 pound size discs, four 2 pound size discs, four 3.5 pound size discs, four 4.5 pound size discs and four 5.5 pound size discs.

Figure 2:
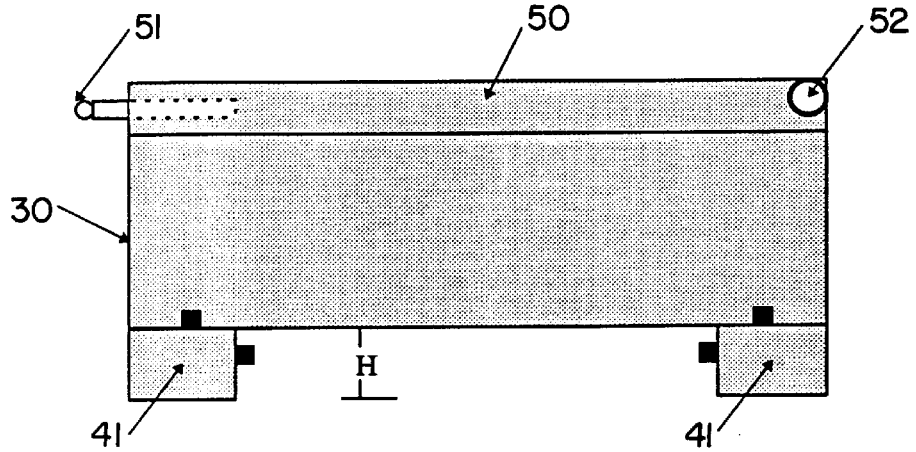
FIG. 2 is side elevation view of the storage case of FIG. 1 with extension blocks attached thereto.
Figure 3:
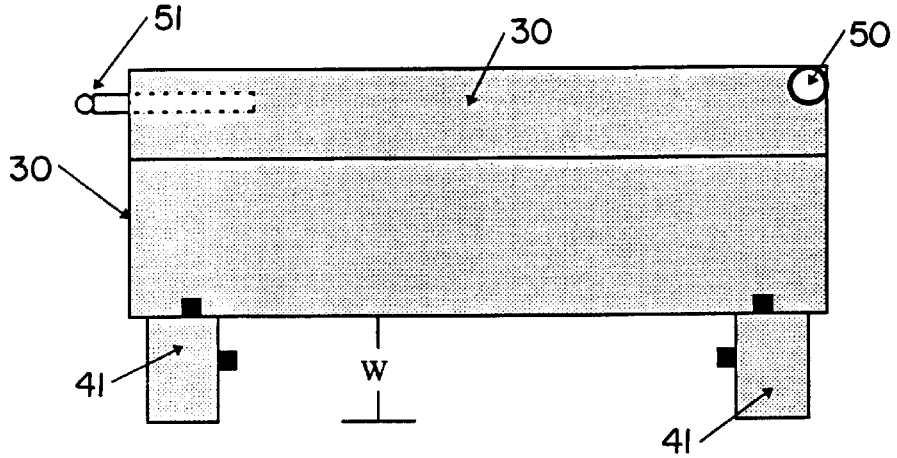
FIG. 3 is a side elevation view of the storage case of FIG. 1 with the extension blocks attached thereto in a different configuration.

As can best be seen in FIGS. 1–3, storage case 30 includes a top or lid 50. The lid may be attached to the storage case with hinges. Snaps, buckles, latches, or other suitable types of similar devices may be used to secure lid 50 to storage case 30. Preferably, the top surface of lid 50 includes at least a portion of non-skid material to reduce the potential of slipping when the exercise system is used for stepping exercises. The entire top surface of the lid may consist of a non-skid material or may simply be roughened plastic. Additionally, the top surface may merely include strips of non-skid material attached thereto.

Preferably, lid 50 includes a telescoping handle 51. Additionally, lid 50 preferably includes two wheels or rollers 52 located on opposite sides of the lid. Alternatively, one roller or wheel may be placed in the center of lid 50 along a bottom edge 50*a* of lid 50. The wheels or rollers, as well as the handle, may instead be arranged on the storage case in a similar arrangement. Handle 51 may be extended so that the storage case may be easily transported by rolling on the wheels 52.

Figure 4A:
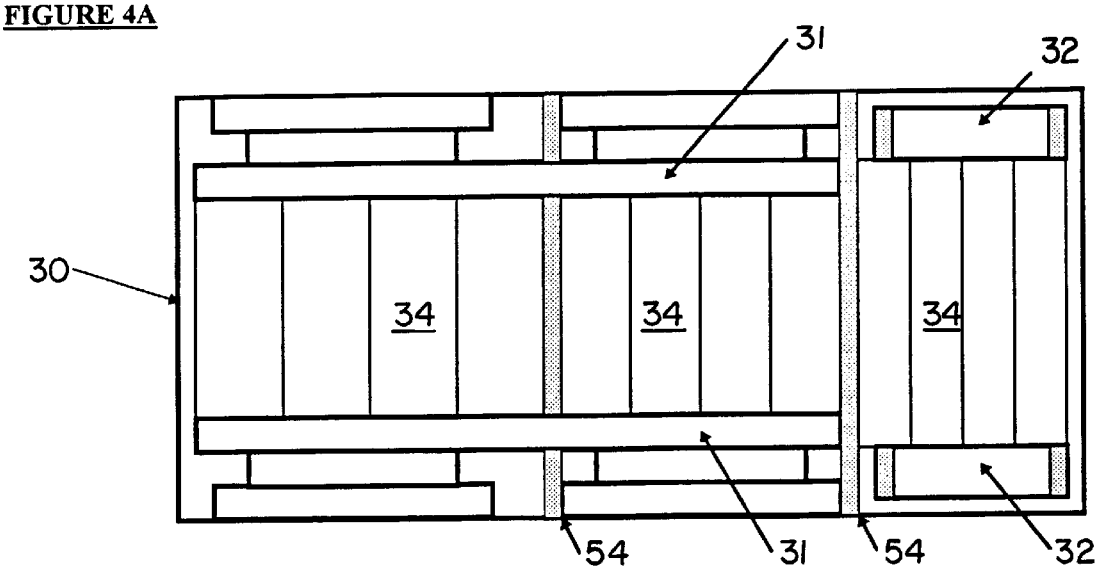
FIG. 4A is a top plan view of the storage case of FIG. 1 with a top cover removed.
Figure 4B:
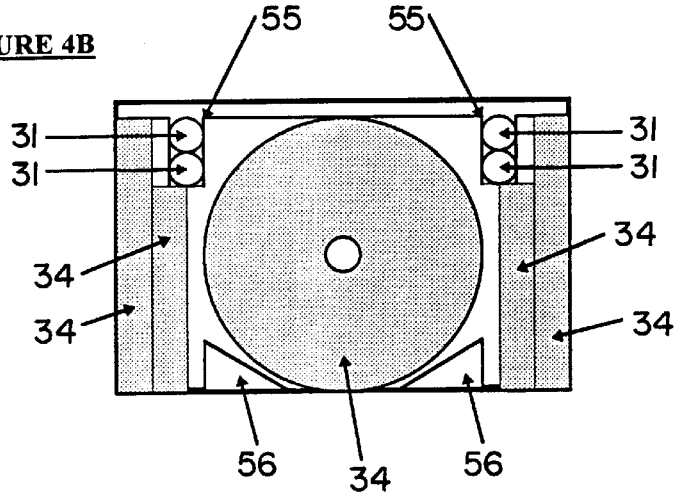
FIG. 4B is an end sectional view of the storage case of FIG. 1 with a top cover removed.
Figure 5:
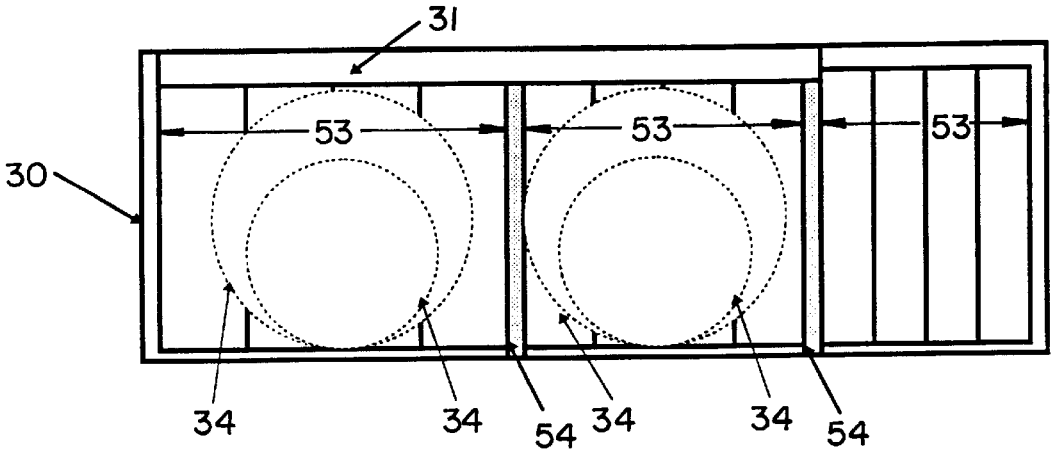
FIG. 5 is a side sectional view of the storage case of FIG. 1.
Figure 6:
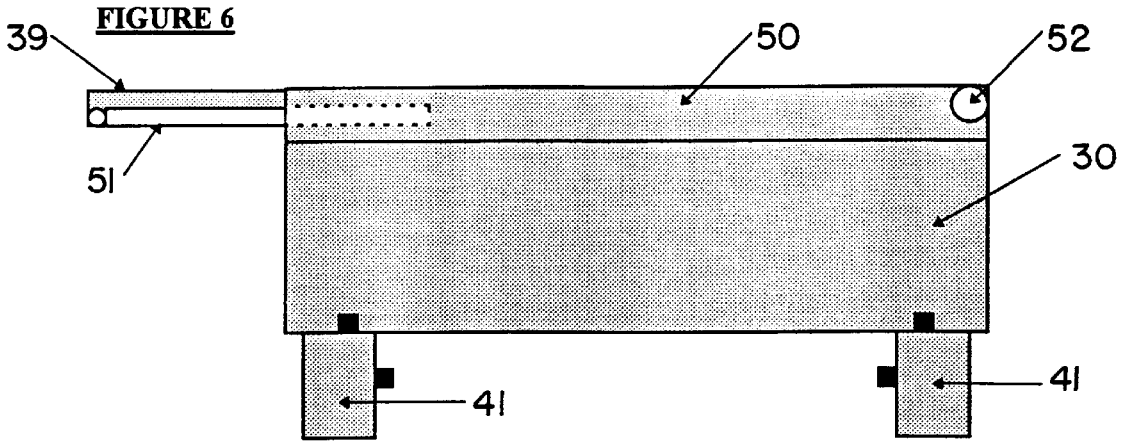
FIG. 6 is a side elevation view of the storage case of FIG. 1 with extension blocks attached thereto and a headrest attached to a handle of the case.
Figure 7:
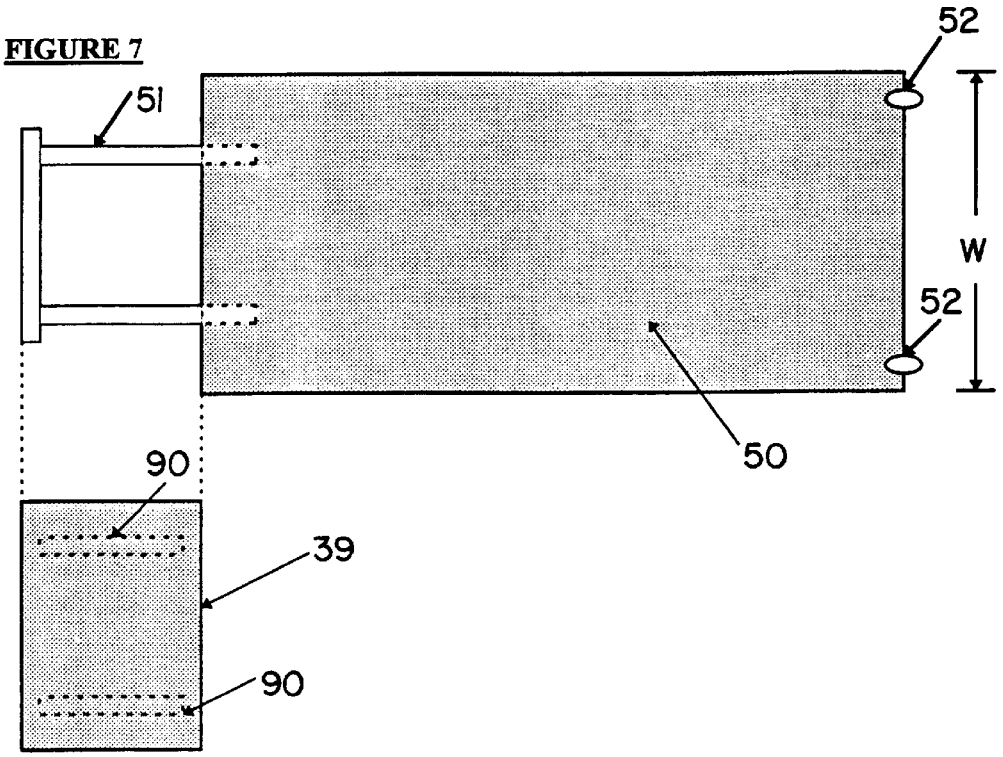
FIG. 7 is a top plan view of the storage case with the handle extended.

FIGS. 4A, 4B and 5 illustrate storage case 30 with cover 50 removed. As can be seen, the storage case is preferably divided into compartments 53 for receiving and storing discs. The compartments are defined by two divider walls 54. Additionally, divider walls 54 include grooves 55 for storing dumbbell bars 31 and fixed guides 56 to hold discs in place within the storage case.

Figure 8A:
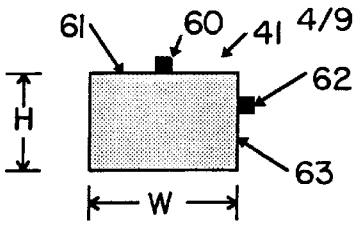
FIG. 8A is a side elevation view of an extension block.
Figure 8B:
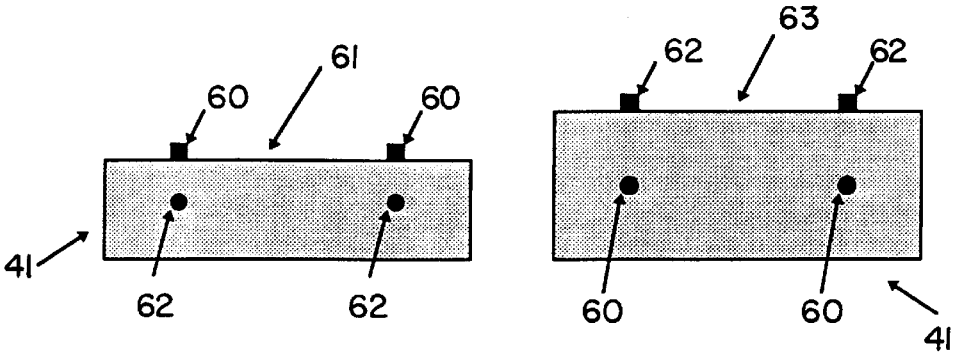
FIG. 8B is a bottom elevation view of the extension block.
Figure 8C:
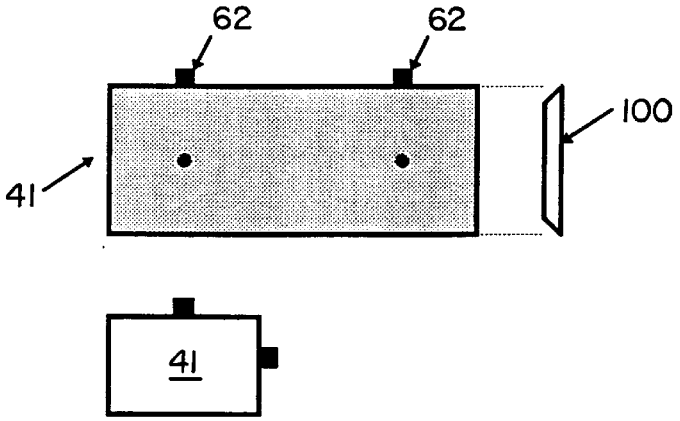
FIG. 8C is a sectional view of the extension block.

As can be seen in FIGS. 8A–8C, the extension blocks preferably include pegs 60 on a top 61 of the extension block and pegs 62 on a front 63 of the extension block.

Storage case 30 and storage compartment 40 include holes 64. Holes 64 cooperate with the pegs for attaching the extension blocks thereto.

Figure 12:
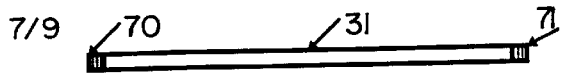
FIG. 12 is an elevation view of a dumbbell bar of the exercise system in accordance with the present invention.
Figure 13:
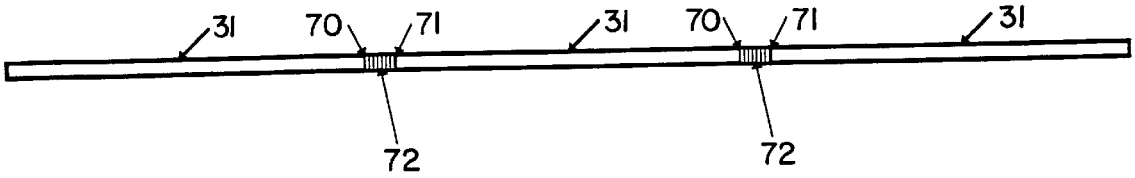
FIG. 13 is an elevation view of three dumbbell bars interconnected to form a barbell bar.
Figure 14:
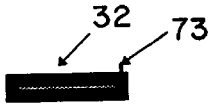
FIG. 14 is an elevation view of a handgrip of the exercise system.

As can be seen in FIG. 12, the dumbbell bars include a threaded extending portion at a first end 70 and a threaded receiving portion at a second end 71. Thus, the dumbbell bars may be interconnected to form a barbell bar as illustrated in FIG. 13. Of course, the extending portion may be non-threaded and simply may be sized to fit snugly within the receiving portion.

Figure 15A:
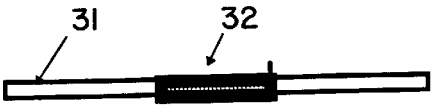
FIG. 15A is an elevation view of a handgrip attached to a dumbbell bar.
Figure 15B:
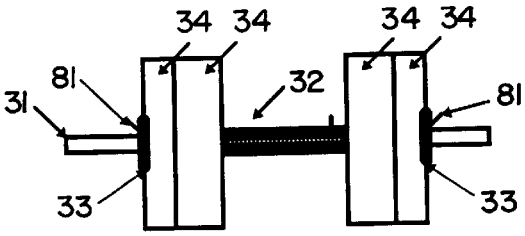
FIG. 15B is an elevation view of a dumbbell bar, a handgrip, weight discs and collars assembled together.
Figure 16A:
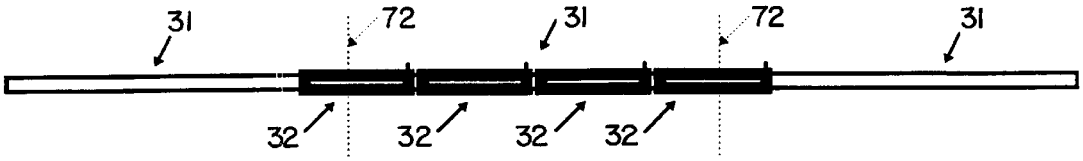
FIG. 16A is an elevation view of handgrips attached to interconnected dumbbell bars.
Figure 16B:
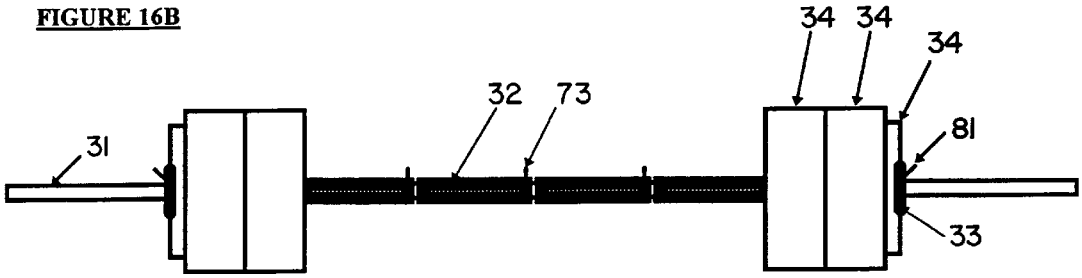
FIG. 16B is an elevation view of three interconnected dumbbell bars, handgrips, weight discs and collars assembled together.
Figure 17:
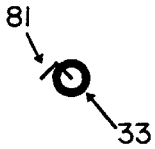
FIG. 17 is an elevation view of a collar of the exercise system.

As can be seen in FIGS. 15A and 15B, the handgrips may be attached to the dumbbell bars for use when the dumbbell bars are being used for dumbbell weight exercises. The handgrips include a thumbscrew 73 or a spring pin (not shown) or other known device for securing the handgrip to the bar. When the dumbbell bars are interconnected to form a barbell, preferably handgrips 32 are placed over points 72 of interconnection to provide additional stability as shown in FIG. 16A. The grips not used to cover interconnection points may by placed on the barbell where desired for comfort and convenience.

Figure 19:
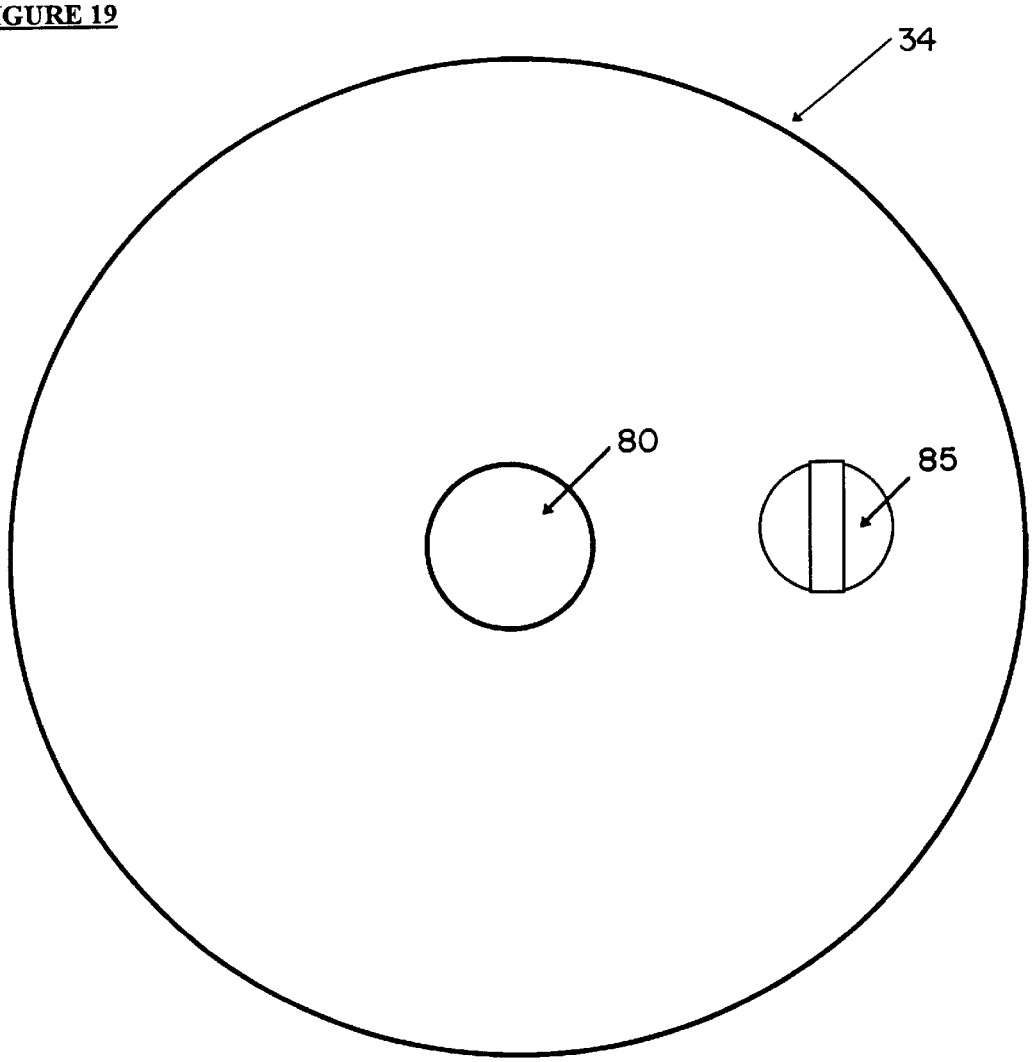
FIG. 19 is a front elevation view of a weight disc of the exercise system.

As can be seen in FIG. 19, each disc 34 includes a water fill plug 85 that is removed to fill the disc with water, thus providing the desired weight according to the size of the disc. Accordingly, when a 1-pound size disc is filled with water, the disc, with the water therein, weighs one pound. Of course, other substances may be used to fill the plate. However, use of other substances may effect the filled disc weight since the density of such substances may be different from water.

Figure 20:
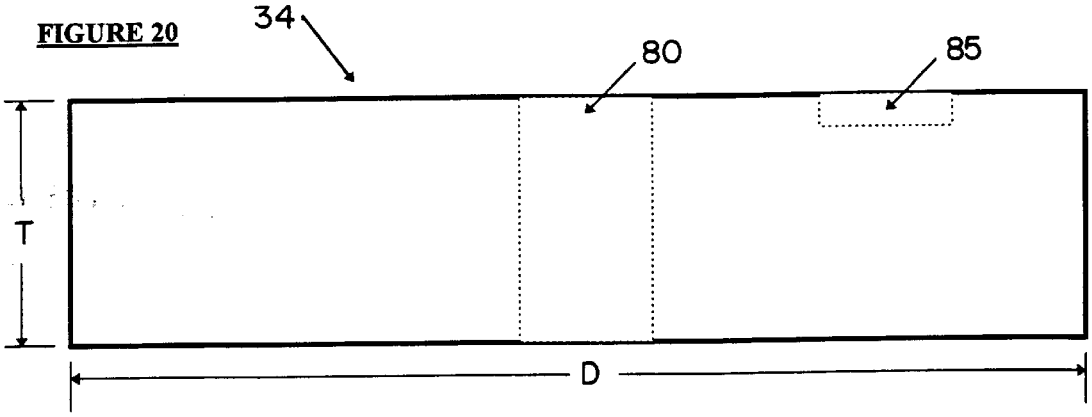
FIG. 20 is a side elevation view of a weight disc of the exercise system.

The discs are sized to provide the appropriate weight accurately when filled with water. For example, a 1-pound size disc has the dimensions of 1" (T in FIG. 20)×6" (D in FIG. 20), a 2-pound size disc has the dimensions of 1"×8", a 3.5-pound disc has the dimensions of 1.5"×8", a 4.5-pound disc has the dimensions of 2.0"×8", and a 5.5-pound disc has the dimensions of 2.5"×8". Of course, depending on the material used to manufacture the discs, the dimensions may vary. Preferably, the discs are made of lightweight, hard plastic. Various forms of ABS plastic are commonly used for fitness products because of their strength, durability, and weight. Obviously, other size discs may be included if desired and more or fewer discs may be included if desired. Also, while preferably there are between three and seven sizes of discs 34 included in the exercise system, and most preferably five sizes of discs, the system may include more or fewer sizes of discs if desired. Fewer sizes of discs limits the versatility of the exercise system while more sizes of discs may increase the size of the exercise system and thereby limit its portability.

Each disc includes a through-hole 80 that is used to engage a dumbbell bar or an interconnected dumbbell bar formed into a barbell bar. Collars 33 are then attached to hold the discs on the bars. Preferably, the exercise system includes eight collars but fewer or more may be included as desired. At least four collars would allow two complete dumbbell bars to be assembled with discs. The collars include a thumb screw 81 or a spring pin (not shown), or other known device for securing the collar to the bar and thus, the filled disc on the bar.

Figure 18:
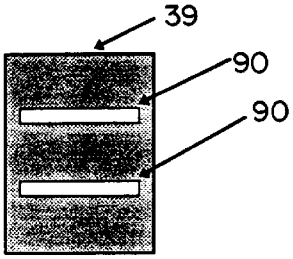
FIG. 18 is a bottom elevation view of the headrest of the exercise system.

As illustrated in FIG. 18, the headrest includes grooves 90 that are configured to attach or snap on to the handle when the handle is extended, thus allowing the storage case to be used as a bench for a user to lie on for various weightlifting exercises.

The extension blocks may be connected to the storage case in order to adjust the height of the storage case as desired. In the preferred embodiment, the extension blocks have a width W of five inches and a height H of three inches. Thus, if the pegs on the top of the extension block are used, the storage case will be extended three inches. If the pegs on the front of the extension block are used to connect to the storage case, the storage case will be extended five inches in height.

In the preferred embodiment, the storage case, with the lid attached, is nine inches in height H' and twenty-six inches long in length L and twelve inches wide (without storage compartment 40 attached) in width W'. Thus, the storage case may be used as a bench for weightlifting exercises or as a bench step for aerobic exercises, and may be adjusted from its nine inch height to heights of twelve inches or fourteen inches, depending upon how the extension blocks are attached. Of course, other sizes and dimensions may be used for the storage case and the extension blocks as desired.

Figure 9:
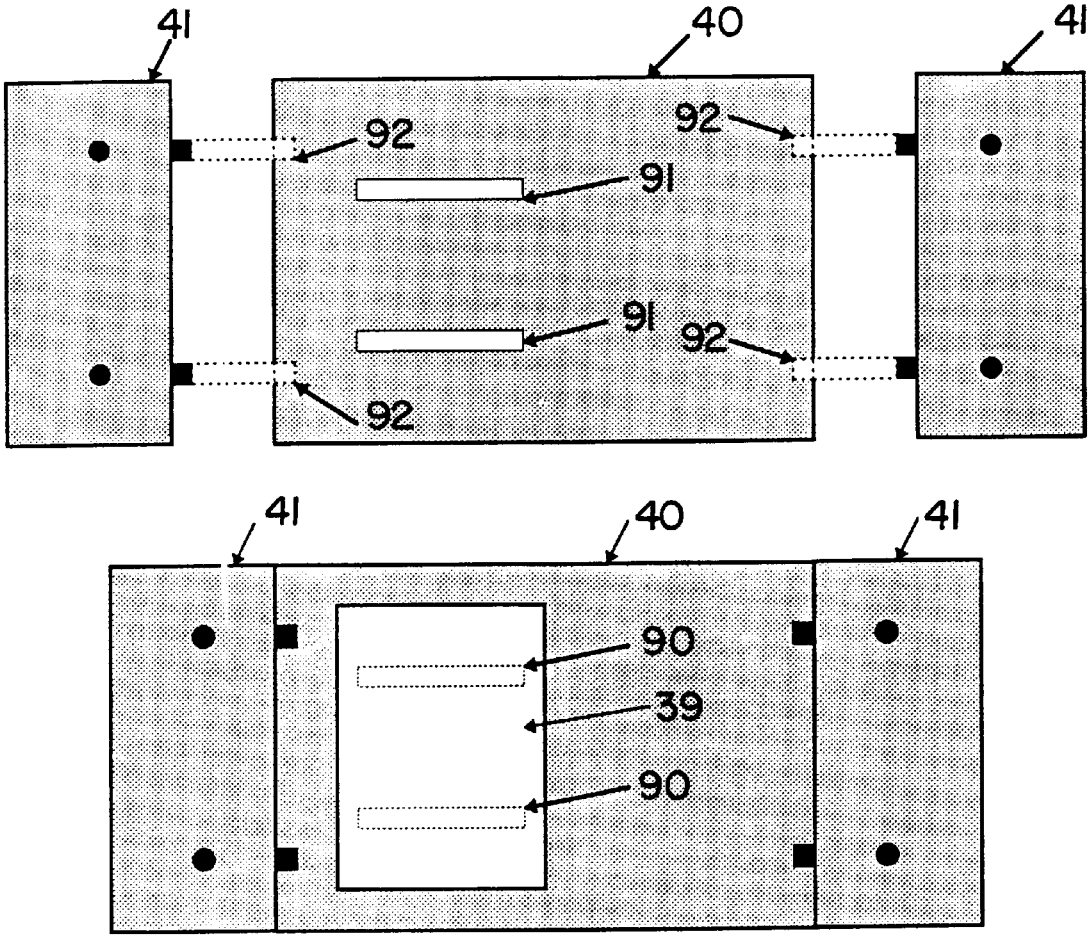
FIG. 9 is a top plan view of a storage compartment that attaches to the storage case.
Figure 10:
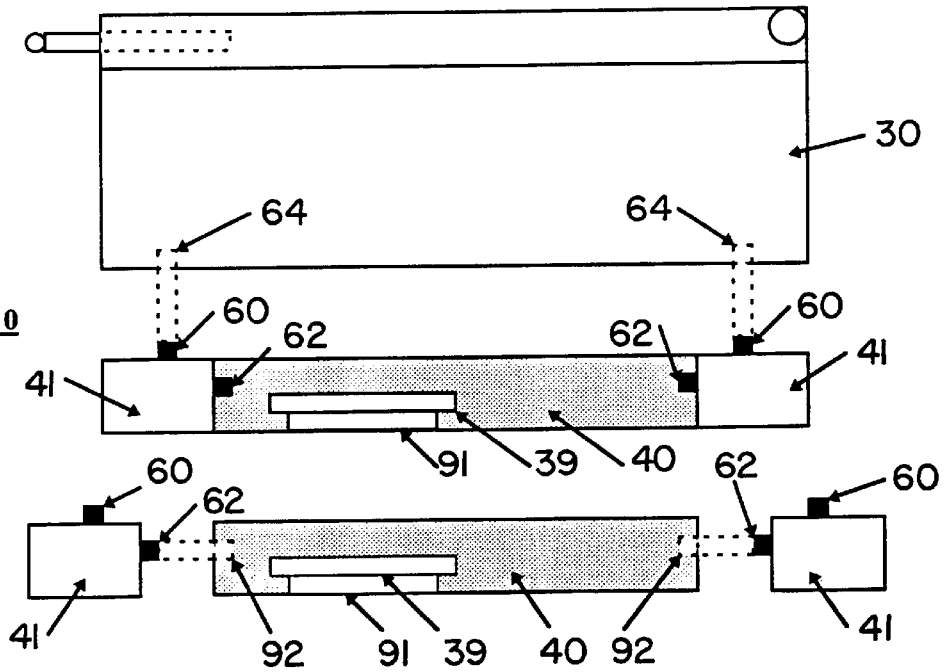
FIG. 10 is a side view of the storage compartment.
Figure 11:
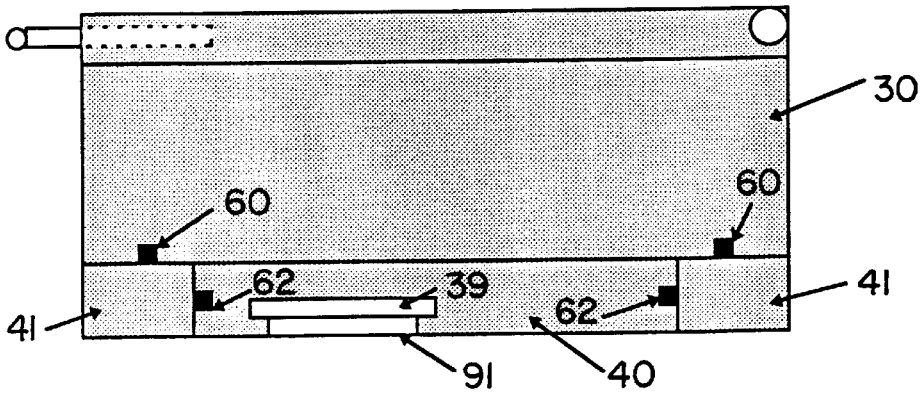
FIG. 11 is a side view of the storage case with the storage compartment and extension blocks attached thereto.

The storage compartment includes two bars 91 therein which receive grooves 90 of the headrest and thus the headrest may be snapped thereon for storage. The storage compartment also includes room for storing materials for exercise, such as towels, gloves, workout brochures and guidelines, etc. The storage compartment includes two holes 92 on each side for receiving the pegs from the front side of the extension blocks. The extension blocks are then attached to the storage case by placing the pegs on the top of the extension blocks into the corresponding holes on the storage case, thereby attaching the extension blocks and the storage compartment to the storage case as illustrated in FIGS. 9–11.

While in the preferred embodiment, pegs and cooperating holes are used to attach the extension blocks to the storage case, it should be understood that other known methods for attaching the extension blocks, such as a tongue-and-groove arrangement, may be used instead of the pegs and cooperating holes described herein.

As can be seen in FIG. 8C, the extension blocks preferably are hollow and include a lid 100. Thus, the extension blocks may be used for additional storage of various items.

Accordingly, in use, the discs are filled with water so that they have the appropriate weight. No measuring is needed and the water does not need to be added or removed in order to adjust the weights of the discs since a plurality of discs of varying sizes is preferably provided. If a dumbbell exercise is desired, handgrips are attached to the dumbbell bars and discs are added thereon. The collars are used to secure the discs to the dumbbell bar. If a barbell exercise is desired, the dumbbell bars are interconnected and grips are added to the barbell bar where desired. Preferably, grips are at least placed over the interconnection points for added stability. Discs are then added to the barbell to provide the desired weight and are secured to the barbell with collars. If a bench press exercise or a butterfly-type exercise is desired, the headrest is preferably attached to the extended handle and a user may lay thereon to perform the exercises. The extension blocks can be added to adjust the height of the storage case if it is so desired.

Additionally, the storage case may be used as a step bench for doing various step exercises.

Preferably, the headrest includes a soft, padded portion on a top side for comfort. Additionally, the lid may include a soft, padded portion for comfort.

When finished with a dumbbell or barbell workout, the discs are preferably drained by removing the plugs and are placed within the storage case in the compartments. Draining of the discs enables easier transport since the empty discs arc obviously lighter. Of course the discs may stored in the storage case while filled to avoid filling and draining of the discs with each workout. The grips are preferably removed and the dumbbell bars are placed in the storage case in the appropriate compartments. Additionally, the grips and collars are stored therein and the lid is placed over the storage case and securely attached. Any materials that are desired to be placed in the storage compartment or extension blocks are placed therein and the headrest is attached within the storage compartment. The extension blocks are then attached to the storage compartment and then attached to the storage case. The entire exercise system may then be moved by extending the handle and rolling it along on the wheels. A handle may be provided on a wall of the storage case so that it may be carried in a manner similar to a suitcase or a briefcase.

Preferably, the entire exercise system is fabricated from lightweight, hard plastic. This will allow the exercise system, when devoid of water or fluid, to weigh approximately 15–20 pounds.

Although the invention has been described with reference to specific exemplary embodiments, it will be appreciated that it is intended to cover all modifications and equivalents within the scope of the appended claims.

What is claimed is:

1. A portable, multi-purpose exercise system comprising:

at least two dumbbell bars;

a plurality of hollow, rigid discs of varying sizes configured for attachment to the dumbbell bars;

a storage case configured for use as a bench step and an exercise bench, the storage case including divided segments for receiving the discs and at least one portion for receiving the dumbbell bars;

a telescoping handle connected to a first end of the storage case and at least one roller connected to an opposite end of the storage case;

a headrest having means for attachment to the handle;

a storage compartment having means for attachment to the storage case and including means for storing the headrest; and at least two extension blocks having means for attachment to the storage case and for attachment to the storage compartment.

2. The exercise system of claim 1 further comprising at least two hand grips configured for connection to the dumbbell bars.

3. The exercise system of claim 2 wherein the exercise system comprises four hand grips configured for connection to the dumbbell bars.

4. The exercise system of claim 1 further comprising eight collars for attachment to the dumbbell bars for locking the discs on the dumbbell bars when the discs are attached thereon.

5. The exercise system of claim 1 wherein the exercise system comprises four dumbbell bars configured for interconnection to form a barbell bar.

6. The exercise system of claim 1 wherein the exercise system comprises four discs of a first size, four discs of a second size, four discs of a third size, four discs of a fourth size, and four discs of a fifth size.

7. A portable, multi-purpose exercise system comprising:

at least four dumbbell bars;

a plurality of hollow, rigid discs of varying sizes configured for attachment to the dumbbell bars;

at least four hand grips configured for attachment to the dumbbell bars;

at least four collars for attachment to the dumbbell bars for locking the discs on the dumbbell bars when the discs are attached thereon;

a storage case configured for use as a bench step and an exercise bench, the storage case comprising divided segments for receiving the discs, at least one portion for receiving the dumbbell bars, a telescoping handle connected to a first end of the storage case and at least one roller connected to an opposite end of the storage case;

a headrest having means for attachment to the handle;

a storage compartment having means for attachment to the storage case and including means for storing the headrest; and at least two extension blocks having means for attachment to the storage case and for attachment to the storage compartment.

8. The exercise system of claim 7 wherein the exercise system comprises four discs of a first size, four discs of a second size, four discs of a third size, four discs of a fourth size, and four discs of a fifth size.

9. The exercise system of claim 7 wherein the exercise system comprises at least eight collars for attachment to the dumbbell bars for locking the discs on the dumbbell bars when the discs are attached thereon.

* * * * *